US005778955A

United States Patent [19]

Chen

[11] Patent Number: 5,778,955

[45] Date of Patent: Jul. 14, 1998

[54] PLEATED CURTAIN FIXING DEVICE

[76] Inventor: Ing-Wen Chen, No. 23, Lane 207, Kao-Feng Road, Hsin-Chu, Taiwan

[21] Appl. No.: 878,156

[22] Filed: Jun. 18, 1997

[51] Int. Cl.[6] ..... E06B 9/06

[52] U.S. Cl. ..... 160/84.06; 160/370.23

[58] Field of Search ..... 160/84.06, 84.03, 160/84.04, 84.01, 87, 113, 117, 370.23, 290.1; 296/97.7, 97.8, 97.9

[56] References Cited

U.S. PATENT DOCUMENTS

| | | | |
|---|---|---|---|
| 4,775,180 | 10/1988 | Phillips | 160/84.04 |
| 4,883,304 | 11/1989 | Elliot | 160/84.04 X |
| 4,886,104 | 12/1989 | Eldridge | 160/370.23 |
| 5,269,360 | 12/1993 | Chen | 160/84.06 |
| 5,377,737 | 1/1995 | Moriya et al. | 160/84.06 |
| 5,477,904 | 12/1995 | Yang | 160/84.06 X |

*Primary Examiner*—David M. Purol

*Attorney, Agent, or Firm*—Pro-Techtor International Services

[57] ABSTRACT

The present invention relates to a fixing device for a pleated curtain, consisting of a left pleated curtain and a right pleated curtain, the fixing device comprising: a left shackle, attached to the moving end of the left pleated curtain and roughly shaped like the letter L, having a main part and a front part, which further has a protrusion and a T-shaped catch on the front side; a right shackle, attached to the moving end of the right pleated curtain and roughly shaped like the letter L, having a main part and a front part with a protrusion on the front side, further having an upper wing plate and a lower wing plate, which are opposite to each other and embrace a T-shaped opening, into which the T-shaped catch of the left shackle fits; and two fixing plates, each of the fixing plates roughly shaped like the letter U with a gap, into which the front part of the left shackle or the right shackle fits, the front leg having on the back side an incision, into which the protrusion of the left shackle or the right shackle fits; wherein the T-shaped catch of the left shackle is inserted in the T-shaped opening of the right shackle, when the curtain is in the unfolded state, and the front parts of the left and right shackles are inserted in the gaps of the fixing plates, when the curtain is in the folded state.

4 Claims, 8 Drawing Sheets b a

PLEATED CURTAIN FIXING DEVICE

BACKGROUND OF THE INVENTION

1. Field of the Invention

The present invention relates to a fixing device for a pleated curtain, particularly to a fixing device for a pleated curtain, having fixing plates and shackles for easy mounting, dismounting and positioning of the pleated curtain.

2. Description of Related Art

A conventional double pleated curtain is fixed in the following way: When closing the curtain, the movable ends are attached to each other by adhesive tapes; when opening the curtain, the adhesive tape on each movable end is attached to an adhesive tape in a fixed position on a frame. However, since the pleated curtains are mainly used in cars and thus exposed to rapid and large temperature changes, the glue becomes ineffective after some time, and the curtain cannot be fixed reliably anymore.

SUMMARY OF THE INVENTION

An object of the present invention is to provide a fixing device for a pleated curtain, which allows to close the curtain quickly.

Another object of the present invention is to provide a fixing device for a pleated curtain, which allows to open the curtain quickly.

A further object of the present invention is to provide a fixing device for a pleated curtain, which allows to close the curtain stably and reliably.

The present invention can be more fully understood by reference to the following description and accompanying drawings.

DETAILED DESCRIPTION OF THE PREFERRED EMBODIMENTS

Figure 1:
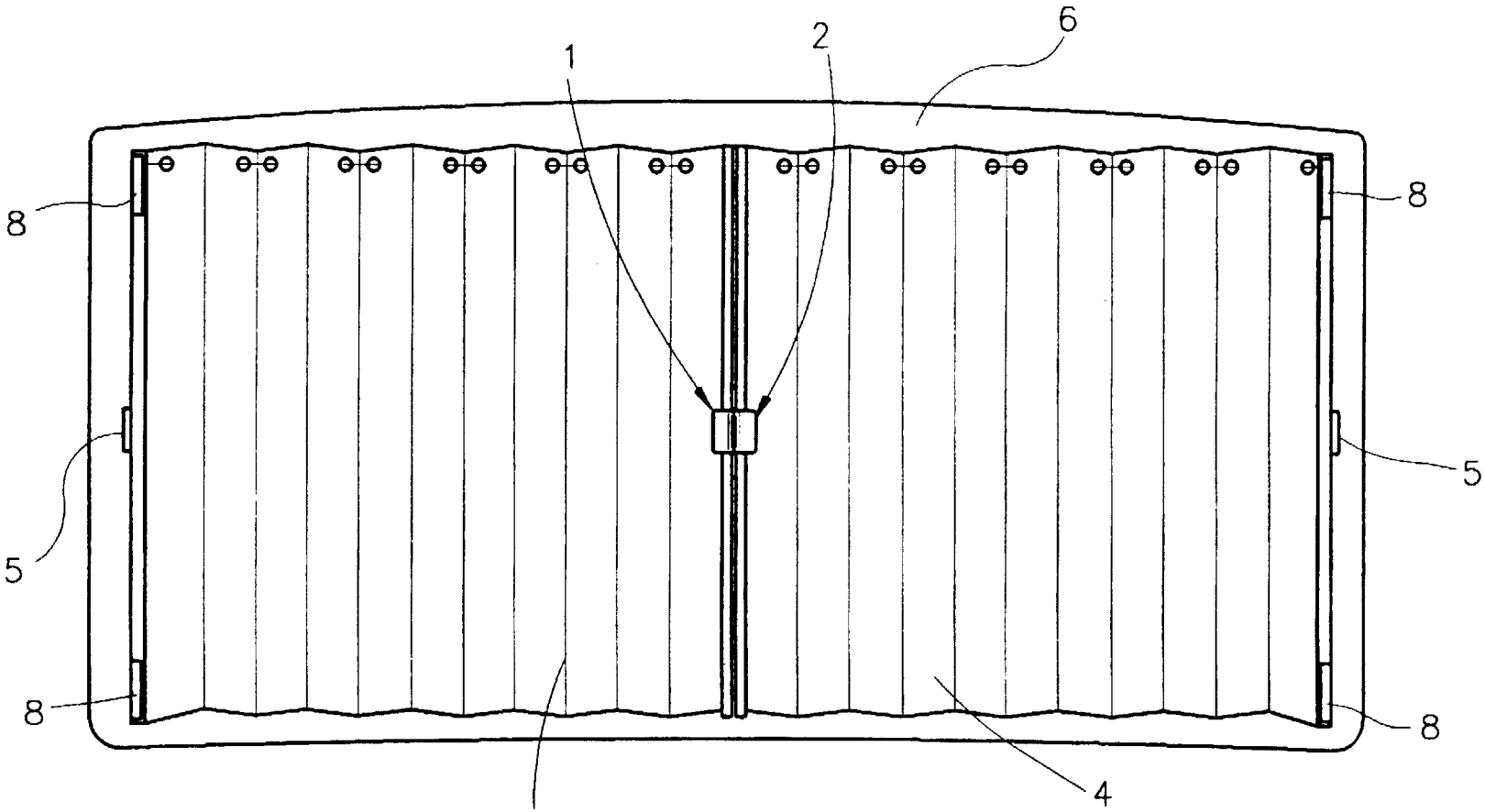
FIG. 1 is a front view of a double pleated curtain in an unfolded state with the fixing device of the present invention.

The fixing device of the present invention is used for a single pleated curtain 4 or a double pleated curtain, consisting of two pleated curtains 3, 4, so as to cover a car window 6. It mainly comprises a pair of fixing plates 5 and a shackle 2 for a single curtain or left and right shackles 1, 2 for a double pleated curtain. The fixing plates 5 are fastened to the window 6 or on a frame. The pleated curtain 3, 4 each have a fixed end and a movable end. For a double pleated curtain, the left and right shackles 1, 2 are each attached to one movable end. When the pleated curtains 3, 4 are unfolded, i.e. closed, the left and right shackles 1, 2 are connected to each other. For a single pleated curtain, the shackle 2 is attached to the movable end. When the pleated curtain 4 is unfolded, the shackle 2 is connected to one of the fixing plates 5. When the curtain is folded, i.e. open, the shackle 2 is connected to the other fixing plate 5.

Figure 2:
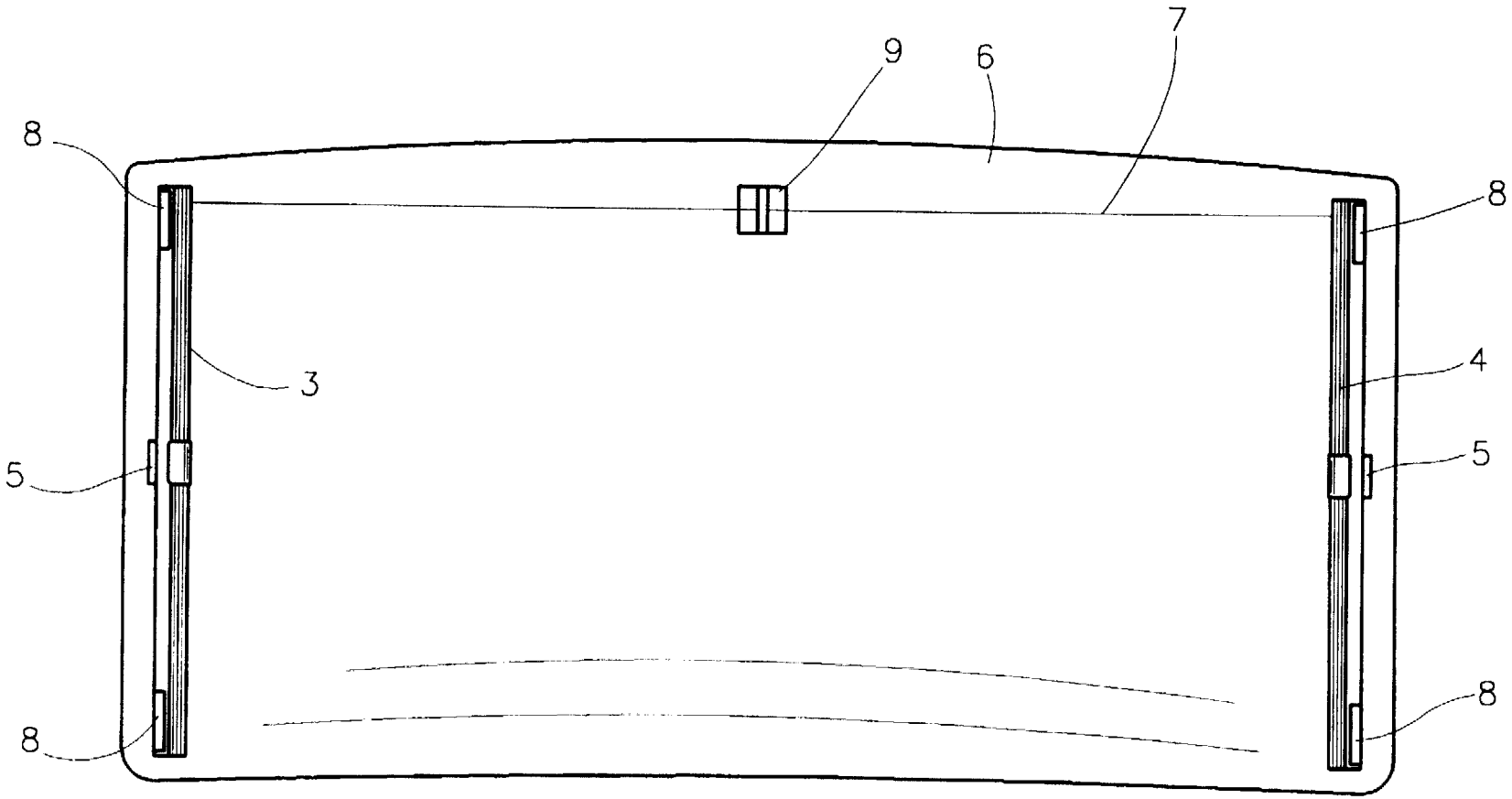
FIG. 2 is a front view of a double pleated curtain in a folded state with the fixing device of the present invention.
Figure 3:
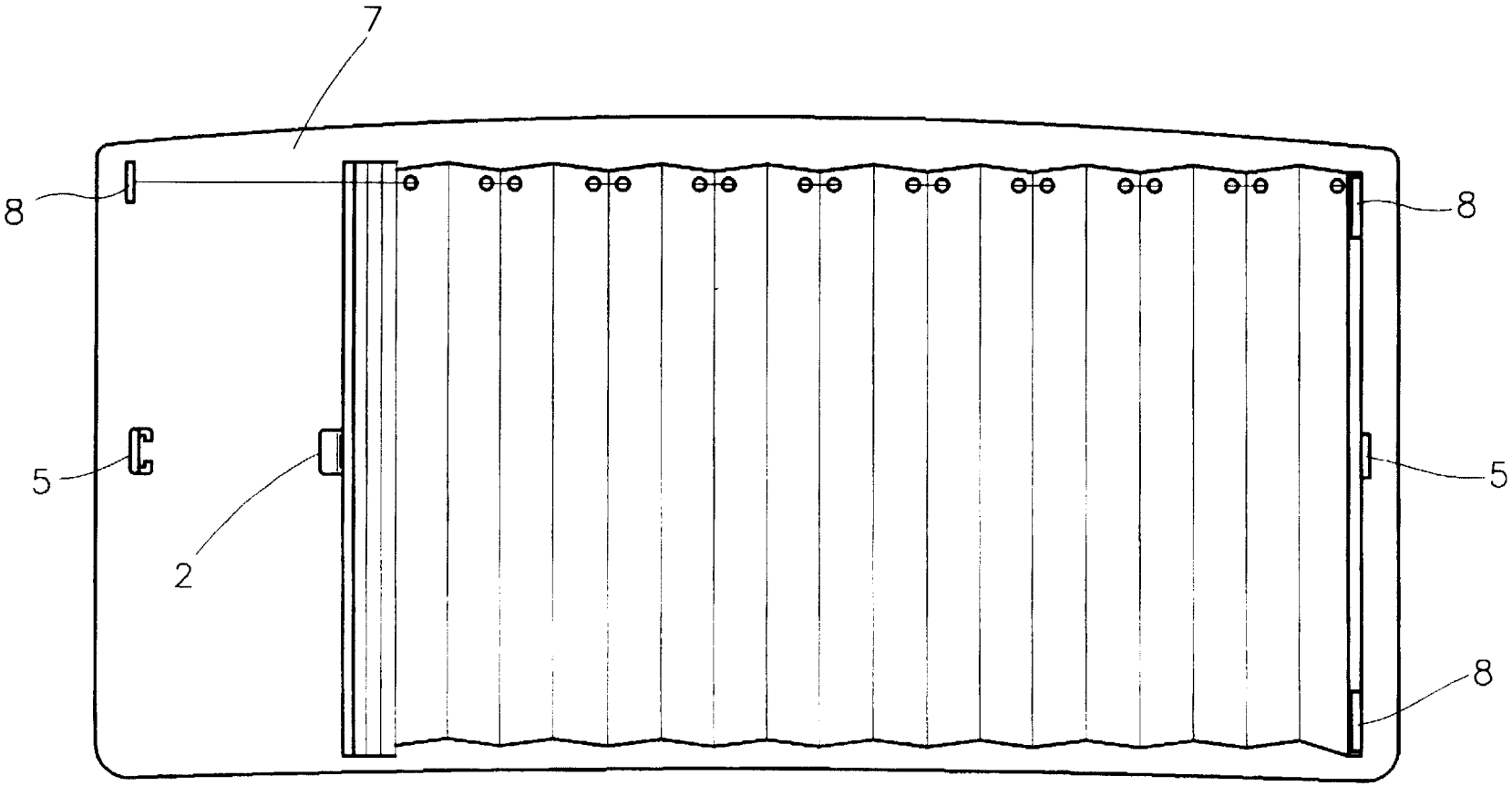
FIG. 3 is a front view of a single pleated curtain with the fixing device of the present invention.
Figure 4:
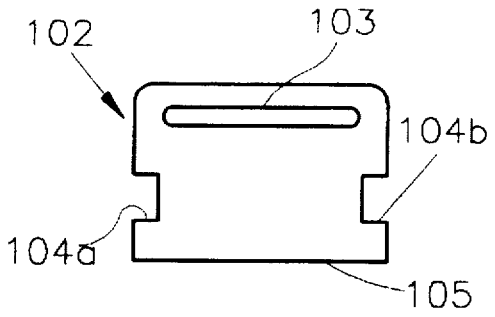
FIG. 4 is a front view of the left shackle of the present invention.
Figure 6:
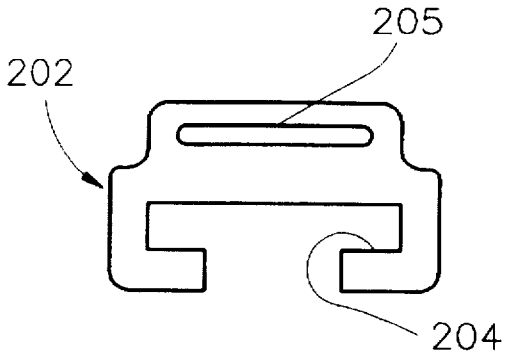
FIG. 6 is a front top view of the right shackle of the present invention.
Figure 5:
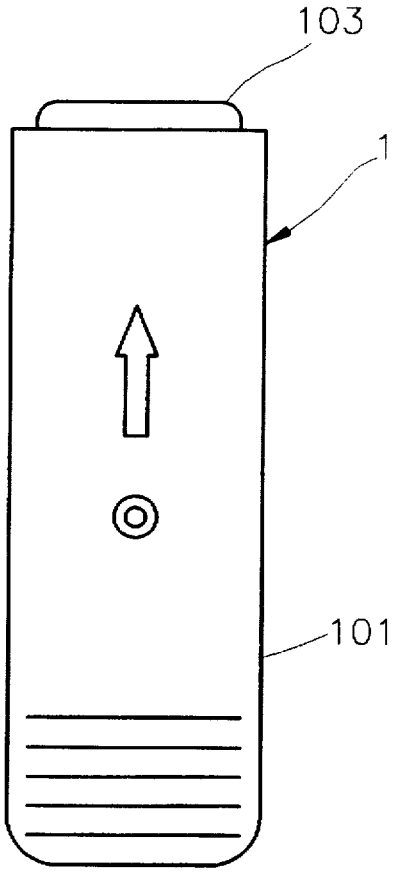
FIG. 5 is a side view of the left shackle of the present invention.

Referring to FIGS. 1 and 2, the fixing device of the present invention has a cord 7, several curtain fasteners 8 and a cord guiding plate 9. These structural elements are the same as for conventionally fixed curtains and do not need to be explained further.

As shown in FIGS. 4, 5, 9 and 10, the left shackle 1 is roughly shaped like the letter L, comprising a main part 101 and an front part 102. The main part 101 is slightly curved towards the far end of the front part 102. It has a hole in the middle, so as to be fixed to the pleated curtain 3. The front part 102 has a protrusion 103 on the front side thereof and on the upper and lower edge, closer to the main part 101, two incisions 104*a*, 104*b*, such that a T-shaped catch 105 is formed.

As shown in FIGS. 6, 7, 12 and 13, the right shackle 2 is roughly shaped like the letter L, comprising a main part 201 and an front part 202. The main part 201 is slightly curved towards the far end of the front part 202. It has a hole in the middle, so as to be fixed to the pleated curtain 4, and, closer to the front part 202, two wing plates 203*a*, 203*b*, embracing an open space between them, such that a T-shaped opening is formed. The front part 202 has a protrusion 205 on the front side thereof.

Figure 8:
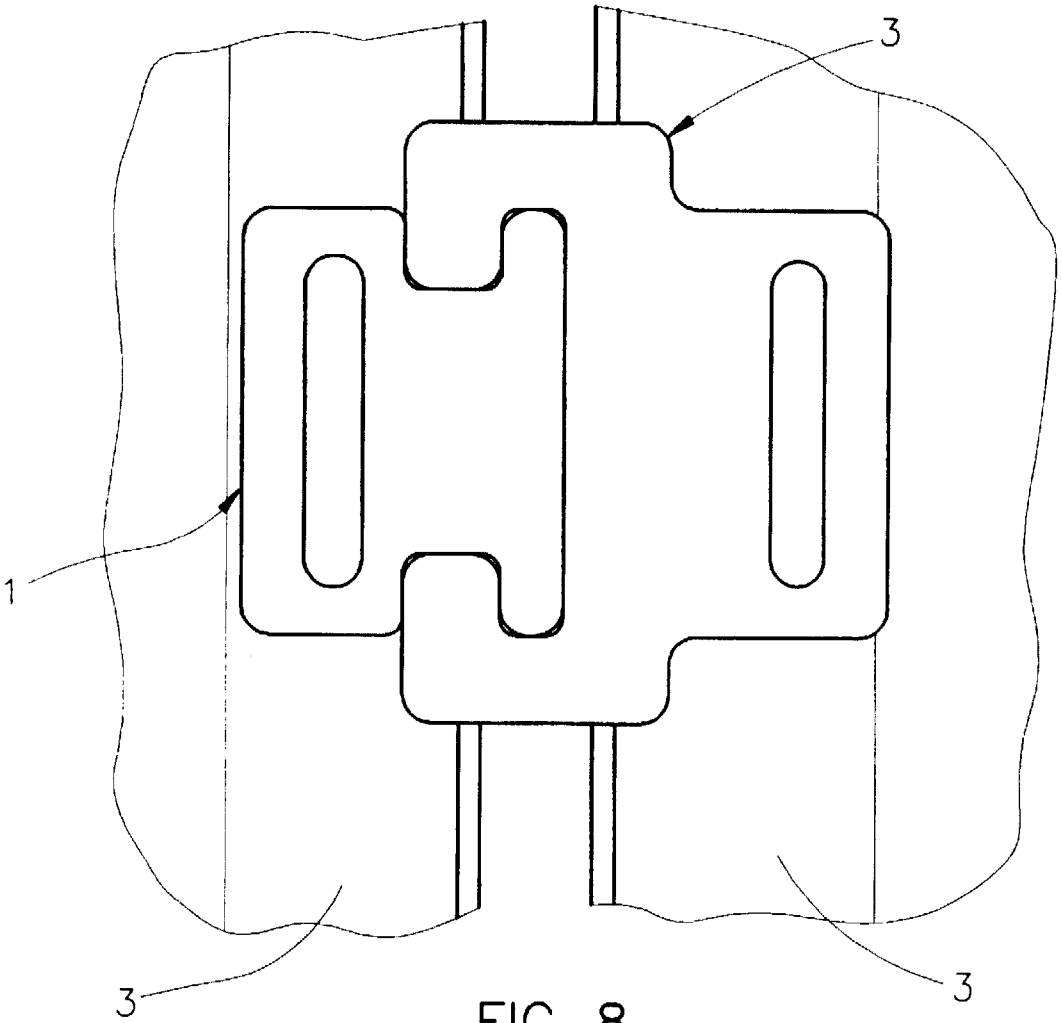
FIG. 8 is a front view of the connected left and right shackles of the present invention.

When the pleated curtains 3, 4 are unfolded, their movable ends are brought together. Then the T-shaped catch 105 of the left shackle 1 is inserted into the T-shaped opening of the right shackle 2 from behind, as shown in FIG. 8.

Figure 7:
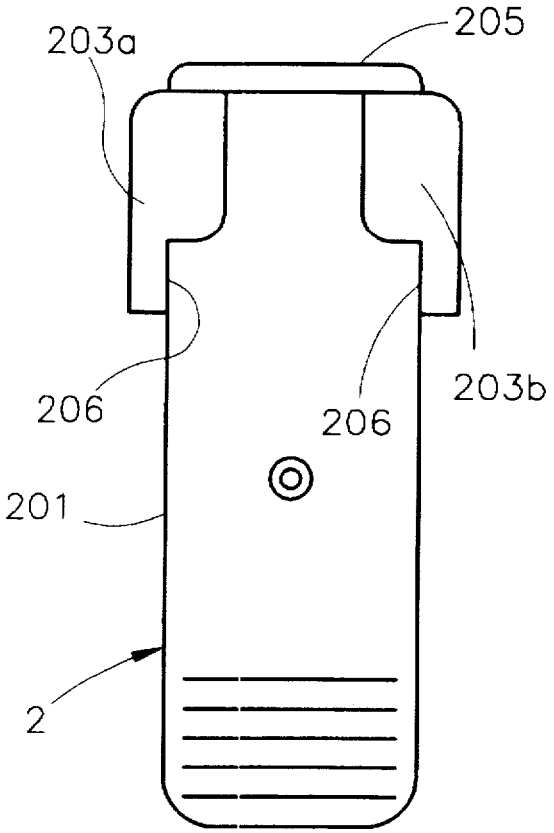
FIG. 7 is a side view of the right shackle of the present invention.

Referring to FIG. 7, the two wing plates 203*a*, 203*b* have relatively narrow rear ends 206 to facilitate inserting the T-shaped catch 105.

Figure 10:
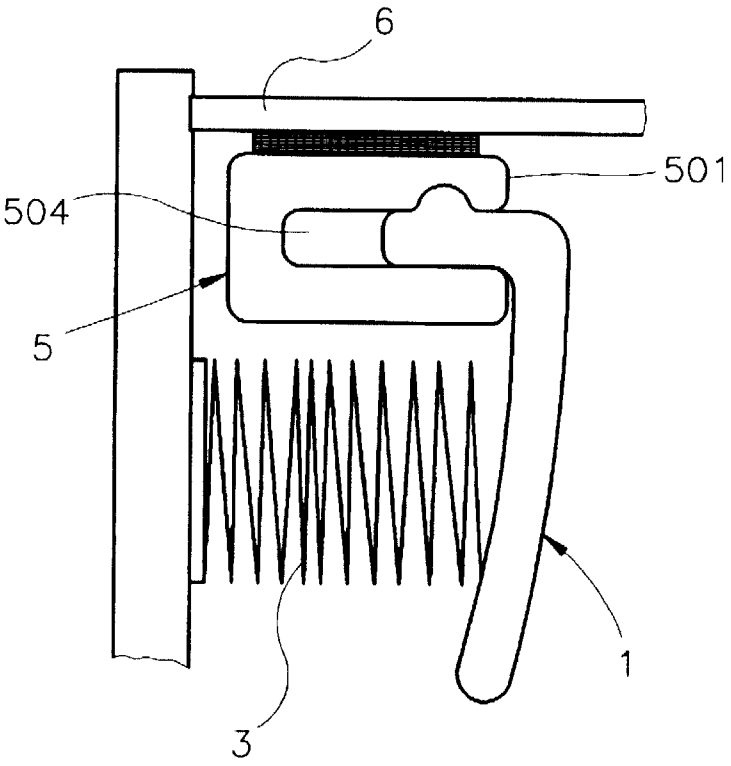
FIG. 10 is a schematic illustration of the connected left shackle and fixing plate of the present invention.
Figure 9:
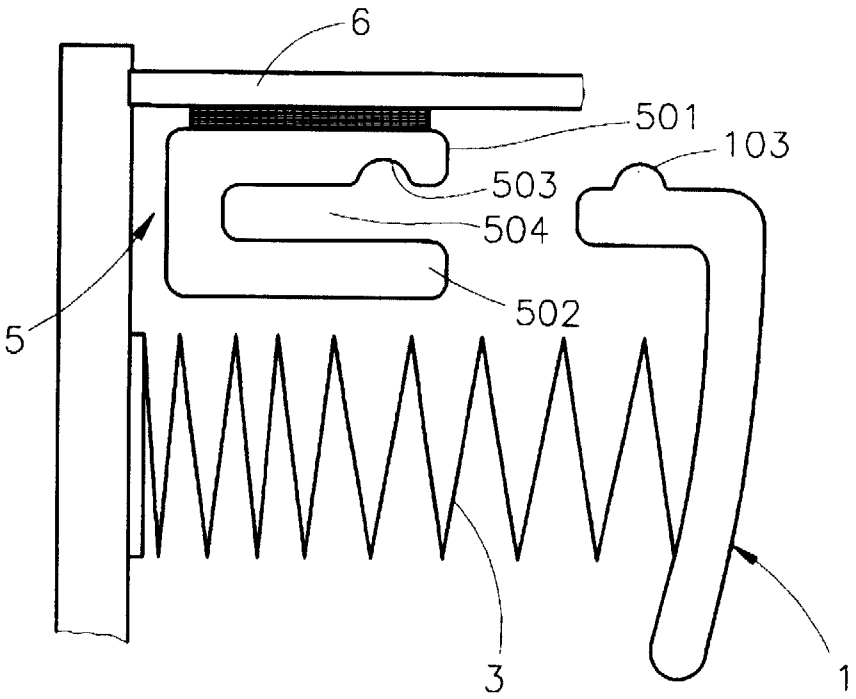
FIG. 9 is a schematic illustration of the disconnected left shackle and fixing plate of the present invention.

As shown in FIGS. 9 and 10, the fixing plate 5 is shaped like the letter U, with an front leg 501 and a rear leg 502, which are separated by a certain distance, leaving a gap 504 in between. The width of the gap 504 is suitable for fitting in the front part 102 of the left shackle 1 or the front part 202 of the right shackle 2. The front side of the front leg 501 is glued to the window 6. The backward, inner side of the front leg 501 is provided with an incision for accommodating the protrusion 103 of the left shackle 1 or the protrusion 205 of the right shackle 2. As shown in FIGS. 1, 2, 9 and 10, the main part 101 of the left shackle 1 is attached to the movable end of the pleated curtain 3. When the pleated curtain 3 is folded, the front part 102 of the left shackle 1 is inserted into the gap 504, with the protrusion 103 slipping into the incision 503.

Figure 11:
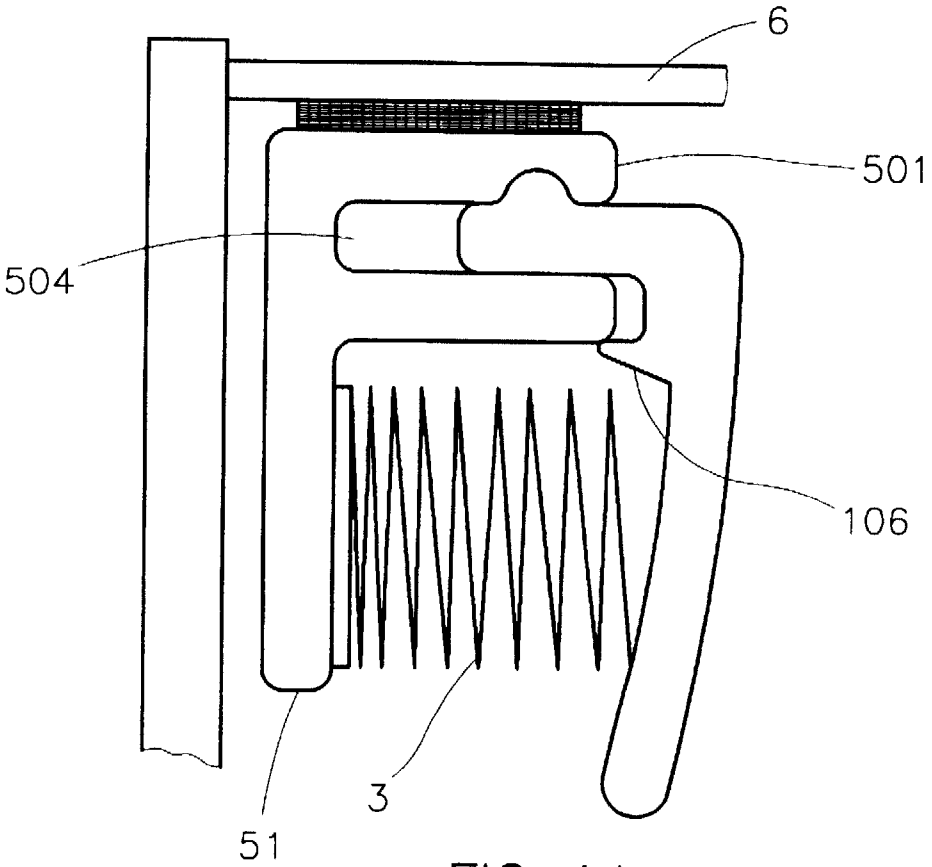
FIG. 11 is a schematic illustration of the connected left shackle and fixing plate of the present invention in another embodiment.

Referring to FIG. 11, in another embodiment of the present invention, the main part 101 of the left shackle 1 has a protrusion 106, which extends outward, parallel to the front part 102, so as to enclose the rear leg 502 of the fixing plate 5, when the pleated curtain 3 is folded.

Figure 13:
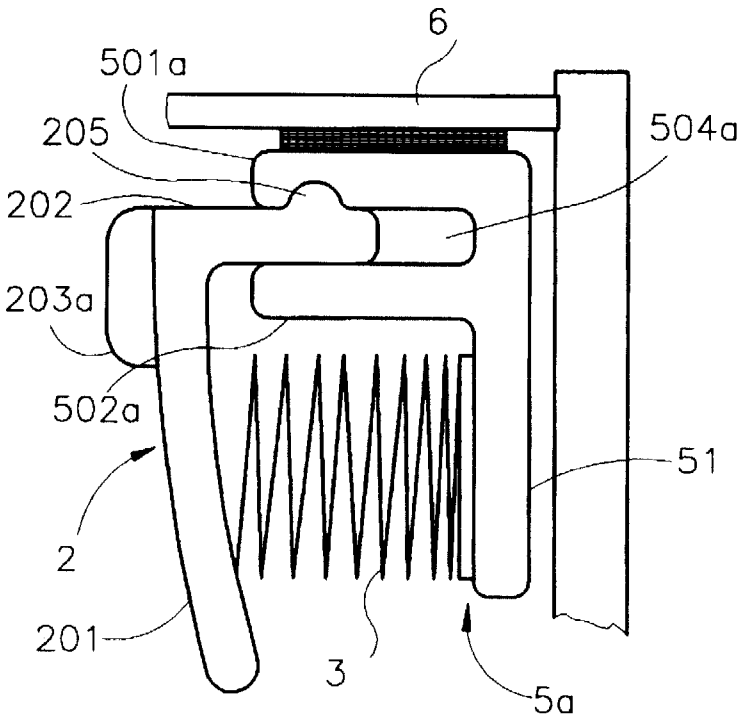
FIG. 13 is a schematic illustration of the connected right shackle and fixing plate of the present invention in a further embodiment.
Figure 12:
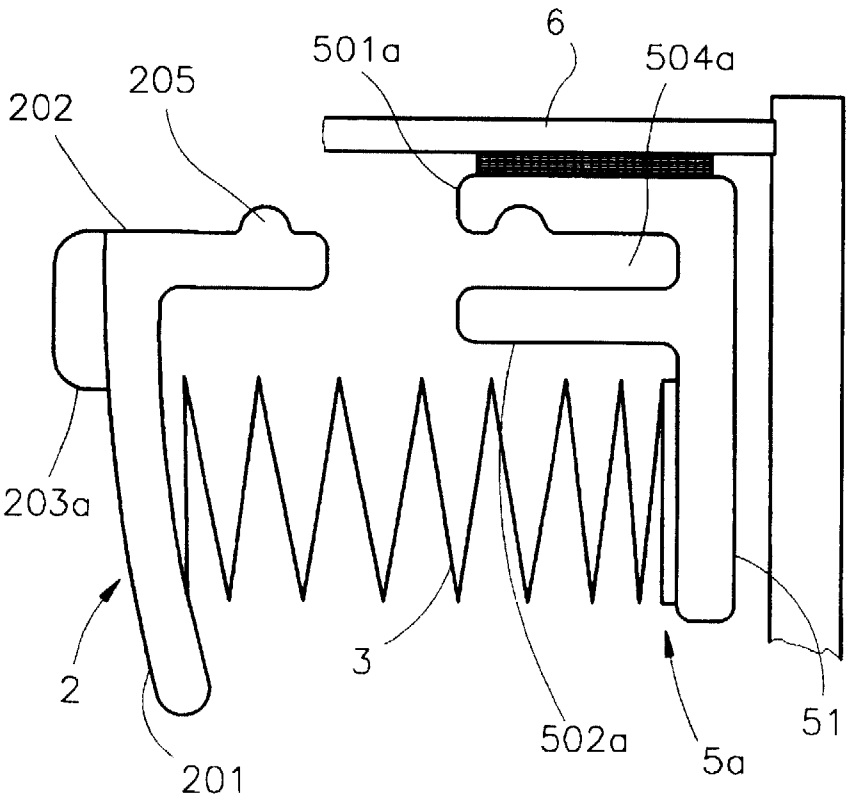
FIG. 12 is a schematic illustration of the disconnected right shackle and fixing plate of the present invention in a further embodiment.

As shown in FIGS. 12 and 13, the present invention in a further embodiment has a fixing plate 5*a*, which is shaped like the letter F, with a main part 51, an front leg 501*a* and a rear leg 502*a*, which are separated by a certain distance, leaving a gap 504*a* between them. The width of the gap 504*a* is suitable for fitting in the front part 102 of the left shackle 1 or the front part 202 of the right shackle 2. The front side of the front leg 501*a* is glued to the window 6. The backward, inner side of the front leg 501*a* is provided with an incision for accommodating the protrusion 103 of the left shackle 1 or the protrusion 205 of the right shackle 2. The fixed end of the pleated curtain 4 is attached to the main part 51. The back side of the main part 201 of the right shackle 2 is attached to the movable end of the pleated curtain 4. When the pleated curtain 4 is folded, the front part 202 of the right shackle 2 is inserted into the gap 504*a*, with the protrusion 205 slipping into the incision 503*a*.

While the invention has been described with reference to preferred embodiments thereof, it is to be understood that modifications or variations may easily be made without departing from the spirit of this invention which is defined by the appended claims.

What is claimed is:

1. A fixing device for a pleated curtain, consisting of a left pleated curtain and a right pleated curtain, both of which have a fixed end and a moving end and two sides that define a front side and a back side, said pleated curtain having an unfolded state and a folded state, said fixing device comprising:

a left shackle, attached to said moving end of said left pleated curtain and roughly shaped like the letter L, having a main part and a front part, which further has a protrusion on said front side and upper and lower edges with two incisions opposite to each other, such that a T-shaped catch is formed, as seen from said front side;

a right shackle, attached to said moving end of said right pleated curtain and roughly shaped like the letter L, having a main part and a front part with a protrusion on said front side, further having an upper wing plate and a lower wing plate, which are opposite to each other and embrace a T-shaped opening, as seen from said front side, into which said T-shaped catch of said left shackle fits; and two fixing plates, each of said fixing plates roughly shaped like the letter U, having a front leg and a rear leg, which enclose a gap, into which said front part of said left shackle or said right shackle fits, said front leg having on said back side an incision, into which said protrusion of said left shackle or said right shackle fits;

wherein said T-shaped catch of said left shackle is inserted in said T-shaped opening of said right shackle, when said curtain is in said unfolded state, and said front parts of said left and right shackles are respectively inserted in said gaps of said fixing plates, when said curtain is in said folded state.

2. A fixing device for a pleated curtain according to claim 1, wherein said main part of said left shackle further has a protrusion, which is parallel to said front part of said left shackle, for enclosing said rear leg of one of said fixing parts, when said curtain is in said folded state.

3. A fixing device for a pleated curtain according to claim 1, wherein said wing plates have narrow ends to facilitate inserting said T-shaped catch into said T-shaped opening.

4. A fixing device for a pleated curtain according to claim 1, wherein said fixing parts are shaped like the letter F.

* * * * *